US009670785B2

(12) United States Patent
Johns et al.

(10) Patent No.: US 9,670,785 B2
(45) Date of Patent: Jun. 6, 2017

(54) COOLING ASSEMBLY FOR A GAS TURBINE SYSTEM

(75) Inventors: David Richard Johns, Simpsonville, SC (US); Kevin Richard Kirtley, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 638 days.

(21) Appl. No.: 13/451,053

(22) Filed: Apr. 19, 2012

(65) Prior Publication Data

US 2013/0280040 A1 Oct. 24, 2013

(51) Int. Cl.
*F01D 5/18* (2006.01)

(52) U.S. Cl.
CPC ..... *F01D 5/188* (2013.01); *F01D 5/18* (2013.01); *F01D 5/181* (2013.01); *F01D 5/186* (2013.01); *F05D 2240/81* (2013.01); *F05D 2250/185* (2013.01); *F05D 2260/201* (2013.01)

(58) Field of Classification Search
CPC . F01D 5/18; F01D 5/181; F01D 5/186; F01D 5/188; F01D 9/06; F01D 9/065
USPC ..... 415/115, 116
See application file for complete search history.

(56) References Cited

U.S. PATENT DOCUMENTS 3,703,808 A * 11/1972 Stearns ..... 415/115
4,292,008 A * 9/1981 Grosjean et al. ..... 415/115
4,668,162 A * 5/1987 Cederwall ..... B23B 51/048 415/115
4,820,116 A * 4/1989 Hovan et al. ..... 415/115
5,320,483 A * 6/1994 Cunha et al. ..... 415/114
5,358,374 A * 10/1994 Correia et al. ..... 415/47
5,399,065 A * 3/1995 Kudo ..... F01D 5/187 415/115
6,435,813 B1 * 8/2002 Rieck, Jr. ..... F01D 5/188 415/115
6,435,814 B1 8/2002 Yu et al.
6,461,107 B1 10/2002 Lee et al.
6,517,312 B1 * 2/2003 Jones ..... F01D 5/189 415/115

(Continued)

FOREIGN PATENT DOCUMENTS

CN 1538039 A 10/2004
CN 1624299 A 6/2005

(Continued)

OTHER PUBLICATIONS

Unofficial English translation of Chinese Office Action issued in connection with corresponding CN Application No. 201310138594.8 on Aug. 5, 2015.

(Continued)

*Primary Examiner* — Craig Kim
*Assistant Examiner* — Brian P Wolcott
(74) *Attorney, Agent, or Firm* — Fletcher Yoder P.C.

(57) ABSTRACT

A cooling assembly for a gas turbine system includes a turbine nozzle having at least one channel comprising a channel inlet configured to receive a cooling flow from a cooling source, wherein the at least one channel directs the cooling flow through the turbine nozzle in a radial direction at a first pressure to a channel outlet. Also included is an exit cavity for fluidly connecting the channel outlet to a region of a turbine component, wherein the region of the turbine component is at a second pressure, wherein the first pressure is greater than the second pressure.

17 Claims, 3 Drawing Sheets

(56) References Cited

U.S. PATENT DOCUMENTS

| | | | |
|---|---|---|---|
| 6,528,118 | B2 | 3/2003 | Lee et al. |
| 6,884,036 | B2 | 4/2005 | Shi et al. |
| 7,029,228 | B2 | 4/2006 | Chan et al. |
| 7,131,813 | B2 | 11/2006 | Tiemann |
| 7,377,743 | B2 | 5/2008 | Flodman et al. |
| 2002/0106457 | A1 | 8/2002 | Lee et al. |
| 2002/0141869 | A1 | 10/2002 | Lee et al. |
| 2011/0259017 | A1 | 10/2011 | Lacy et al. |

FOREIGN PATENT DOCUMENTS

| | | | |
|---|---|---|---|
| JP | 04-179802 | A | 6/1992 |
| JP | 06-029575 | B2 | 4/1994 |
| JP | 2001-323802 | A | 11/2001 |
| JP | 2001-349202 | A | 12/2001 |
| JP | 2004-144081 | A | 5/2004 |
| JP | 2007-170375 | A | 7/2007 |
| RU | 2387846 | C1 | 4/2010 |

OTHER PUBLICATIONS

JP Notice of Preliminary Rejection in Japanese Application No. 2013-086180 dated Feb. 7, 2017 (9 pages).
RU Office Action in Russian Application No. 2013117918/06(026484) dated Feb. 22, 2017 (9 pages).

* cited by examiner

COOLING ASSEMBLY FOR A GAS TURBINE SYSTEM

BACKGROUND OF THE INVENTION

The subject matter disclosed herein relates to gas turbine systems, and more particularly to a cooling assembly for components within such gas turbine systems.

In gas turbine systems, a combustor converts the chemical energy of a fuel or an air-fuel mixture into thermal energy. The thermal energy is conveyed by a fluid, often compressed air from a compressor, to a turbine where the thermal energy is converted to mechanical energy. As part of the conversion process, hot gas is flowed over and through portions of the turbine as a hot gas path. High temperatures along the hot gas path can heat turbine components, causing degradation of components.

Radially outer components of the turbine section, such as turbine shroud assemblies, as well as radially inner components of the turbine section are examples of components that are subjected to the hot gas path. Various cooling schemes have been employed in attempts to effectively and efficiently cool such turbine components, but cooling air supplied to such turbine components is often wasted and reduces overall turbine engine efficiency.

BRIEF DESCRIPTION OF THE INVENTION

According to one aspect of the invention, a cooling assembly for a gas turbine system includes a turbine nozzle having at least one channel comprising a channel inlet configured to receive a cooling flow from a cooling source, wherein the at least one channel directs the cooling flow through the turbine nozzle in a radial direction at a first pressure to a channel outlet. Also included is an exit cavity for fluidly connecting the channel outlet to a region of a turbine component, wherein the region of the turbine component is at a second pressure, wherein the first pressure is greater than the second pressure.

According to another aspect of the invention, a cooling assembly for a gas turbine system includes a turbine nozzle disposed between a radially inner segment and a radially outer segment, the turbine nozzle having a plurality of channels each comprising a channel inlet configured to receive a cooling flow from a cooling source, wherein the plurality of channels directs the cooling flow through the turbine nozzle in a radial direction to a channel outlet. Also included is a plurality of rotor blades rotatably disposed between a rotor shaft and a stationary turbine shroud assembly supported by a turbine casing, wherein the stationary turbine shroud assembly is located downstream of the turbine nozzle. Further included is an exit cavity fully enclosed by a hood segment for fluidly connecting the channel outlet to the stationary turbine shroud assembly, wherein the cooling flow is transferred to the stationary turbine shroud assembly.

According to yet another aspect of the invention, a gas turbine system includes a compressor for distributing a cooling flow at a high pressure. Also included is a turbine casing operably supporting and housing a first stage turbine nozzle having a plurality of channels for receiving the cooling flow for cooling the first stage turbine nozzle and directing the cooling flow radially through the first stage turbine nozzle. Further included is a first turbine rotor stage rotatably disposed radially inward of a first stage turbine shroud assembly, wherein the first stage turbine shroud assembly is disposed downstream of the first stage turbine nozzle. Yet further included is an enclosed exit cavity fluidly connecting at least one of the plurality of channels to the first stage turbine shroud assembly for delivering the cooling flow to the first stage turbine shroud assembly.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
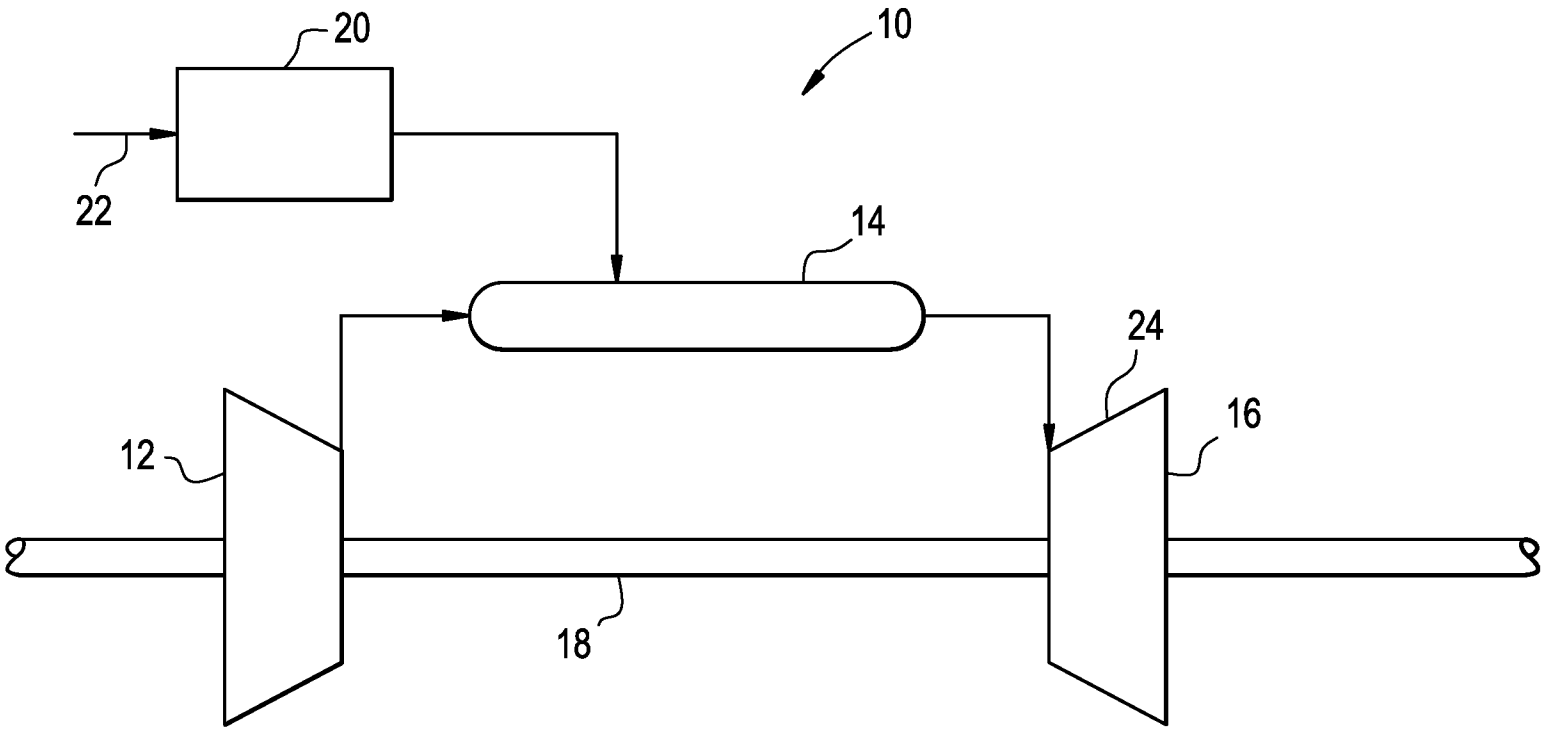
FIG. 1 is a schematic illustration of a gas turbine system.

Referring to FIG. 1, a gas turbine system is schematically illustrated with reference numeral 10. The gas turbine system 10 includes a compressor 12, a combustor 14, a turbine 16, a shaft 18 and a fuel nozzle 20. It is to be appreciated that one embodiment of the gas turbine system 10 may include a plurality of compressors 12, combustors 14, turbines 16, shafts 18 and fuel nozzles 20. The compressor 12 and the turbine 16 are coupled by the shaft 18. The shaft 18 may be a single shaft or a plurality of shaft segments coupled together to form the shaft 18.

The combustor 14 uses a combustible liquid and/or gas fuel, such as natural gas or a hydrogen rich synthetic gas, to run the gas turbine system 10. For example, fuel nozzles 20 are in fluid communication with an air supply and a fuel supply 22. The fuel nozzles 20 create an air-fuel mixture, and discharge the air-fuel mixture into the combustor 14, thereby causing a combustion that creates a hot pressurized exhaust gas. The combustor 14 directs the hot pressurized gas through a transition piece into a turbine nozzle (or "stage one nozzle"), and other stages of buckets and nozzles causing rotation of turbine blades within a turbine casing 24. Rotation of the turbine blades causes the shaft 18 to rotate, thereby compressing the air as it flows into the compressor 12. In an embodiment, hot gas path components are located in the turbine 16, where hot gas flow across the components causes creep, oxidation, wear and thermal fatigue of turbine components. Examples of hot gas components include bucket assemblies (also known as blades or blade assemblies), nozzle assemblies (also known as vanes or vane assemblies), shroud assemblies, transition pieces, retaining rings, and compressor exhaust components. The listed components are merely illustrative and are not intended to be an exhaustive list of exemplary components subjected to hot gas. Controlling the temperature of the hot gas components can reduce distress modes in the components.

Figure 2:
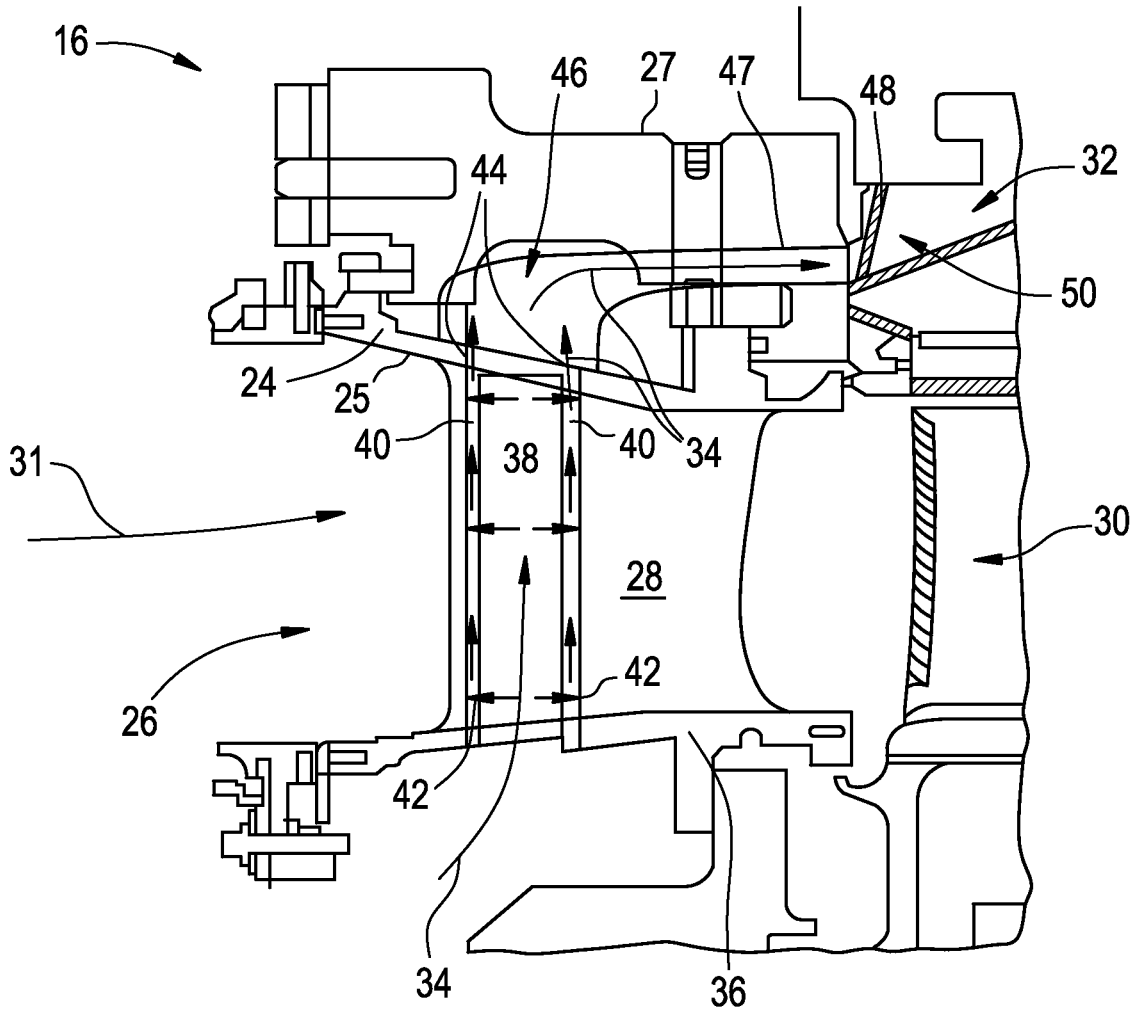
FIG. 2 is an elevational, side view of a cooling assembly of a first embodiment for the gas turbine system.

Referring to FIG. 2, an inlet region 26 of the turbine 16 is illustrated and includes a turbine nozzle 28, such as a first stage turbine nozzle, and a rotor stage assembly 30, such as a first rotor stage assembly. Although described in the context of the first stage, it is to be appreciated that the turbine nozzle 28 and the rotor stage assembly 30 may be downstream stages. A main hot gas path 31 passes over and through the turbine nozzle 28 and the rotor stage assembly 30. The rotor stage assembly 30 is operably connected to the shaft 18 (FIG. 1) and is rotatably mounted radially inward of a turbine shroud assembly 32. The turbine shroud assembly 32 is typically relatively stationary and is operably supported by the turbine casing 24. Additionally, the turbine shroud assembly 32 functions as a sealing component with the rotating rotor stage assembly 30 for increasing overall gas turbine system 10 efficiency by reducing the amount of hot gas lost to leakage around the circumference of the rotor stage assembly 30, thereby increasing the amount of hot gas that is converted to mechanical energy. Based on the proximity to the main hot gas path 31, the turbine shroud assembly 32 requires a cooling flow 34 from a cooling source. The cooling source is typically the compressor 12, which in addition to providing compressed air for combustion with a combustible fuel, as described above, provides a secondary airflow, referred to herein as the cooling flow 34. The cooling flow 34 is a high-pressure airstream that bypasses the combustor 14 for delivery to selected regions requiring the cooling flow 34 to counteract heat transfer from the main hot gas path 31.

In a first embodiment (FIG. 2), the turbine nozzle 28 is disposed upstream of the rotor stage assembly 30 and extends radially between, and is operably mounted to and supported by, an inner segment 36 proximate the shaft 18 and an outer segment, which may correspond to the turbine casing 24 having an inner wall 25 and an outer wall 27. The turbine nozzle 28 also requires the cooling flow 34 and is configured to receive the cooling flow 34 proximate the inner segment 36 via one or more main channels 38 that impinges the cooling flow 34 to at least one impingement region within the turbine nozzle 28. Alternatively, the cooling flow 34 may be directed through the turbine nozzle 28 via a serpentine flow circuit comprising a plurality of flow paths. At least one, but typically a plurality of microchannels 40 disposed at interior regions of the turbine nozzle 28 each comprise at least one channel inlet 42 and at least one channel outlet 44. The at least one channel inlet 42 is disposed proximate either the impingement region or at least one of the plurality of flow paths of the serpentine flow circuit. The at least one channel outlet 44 is located proximate the radially outer segment, or turbine casing 24, and expels the cooling flow 34 to an exit cavity 46 that directs the cooling flow 34 axially downstream toward the turbine shroud assembly 32. The exit cavity 46 is at a lower pressure than the interior regions of the turbine nozzle disposed at upstream locations through which the cooling flow 34 is transferred through. Rather than ejecting the cooling flow 34 into the main hot gas path 31, the exit cavity 46 is partially or fully enclosed with a cover or hood 47 to "reuse" the cooling flow 34 by securely passing it downstream to the turbine shroud assembly 32, which requires cooling, as described above, and typically employs additional cooling flow from the cooling source, such as the compressor 12. Specifically, the exit cavity 46 directs the cooling flow 34 to a forward face 48 of the turbine shroud assembly 32, and more particularly to an interior region 50 of the turbine shroud assembly 32, where the cooling flow 34 passes through an aperture of the forward face 48. The interior region 50 encloses a volume having a pressure less than that of the microchannels 40 and the exit cavity 46, referred to as upstream regions. The upstream regions have a first pressure and the interior region 50 has a second pressure, with the second pressure being lower than that of the first pressure, as noted above. The pressure differential between the first pressure and the second pressure causes the cooling flow 34 to be drawn to the lower second pressure from the higher pressure upstream regions. Delivery of the cooling flow 34 provides a cooling effect on the turbine shroud assembly 32. By reducing the amount of cooling flow required from the compressor 12, a more efficient operation of the gas turbine system 10 is achieved.

Figure 3:
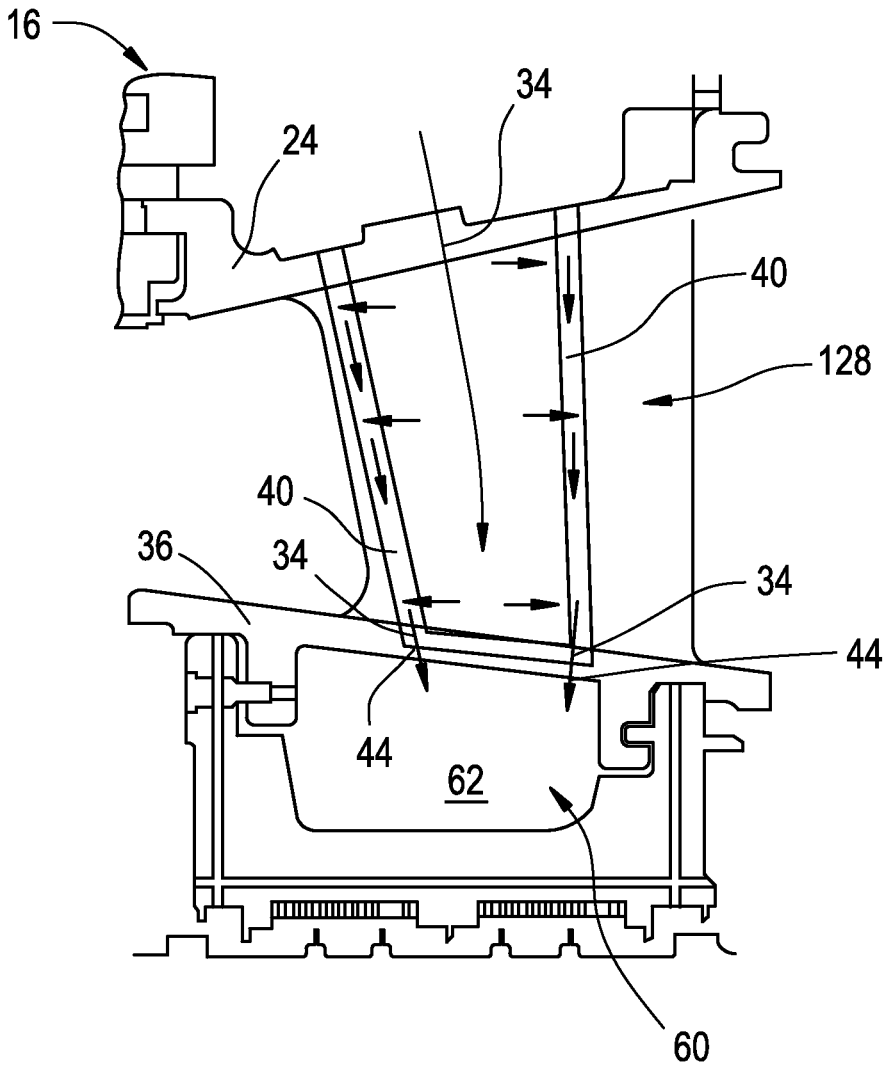
FIG. 3 is an elevational, side view of the cooling assembly of a second embodiment for the gas turbine system.

Referring now to FIG. 3, a second embodiment of the turbine nozzle is illustrated and referred to with numeral 128. The turbine nozzle 128 is similar in several respects to the first embodiment of the turbine nozzle 28, both in construction and functionality, with one notable distinction. The turbine nozzle 128 is cantilever mounted to the outer segment, such as the turbine casing 24. In the illustrated embodiment, the cooling flow 34 is supplied proximate the turbine casing 24 to the turbine nozzle 128 and directed internally through the microchannels 40 in a radially inward direction toward the shaft 18. Here, the at least one channel outlet 44 is disposed proximate the inner segment 36, and more particularly proximate a nozzle diaphragm 60, which is configured to receive the cooling flow 34 and may be referred to interchangeably with the exit cavity 46 described above. As is the case with the interior region 50 of the turbine shroud assembly 32 in the first embodiment, the nozzle diaphragm 60 comprises a relatively low pressure volume 62 that draws the cooling flow 34 from the at least one channel outlet 44 into the nozzle diaphragm 60 for cooling therein. In this configuration, post-impinged air is transferred to the nozzle diaphragm 60 via the microchannels 40, thereby preventing the post-impinged air from degrading impingement. Alternatively, the cooling flow 34 may be directed through the turbine nozzle 28 via a serpentine flow circuit comprising a plurality of flow paths.

The cooling flow 34 may further be transferred past the nozzle diaphragm 60 through an inner support ring to a wheel space disposed proximate the shaft 18. This is facilitated by partially or fully enclosing a path through the inner support ring with the cover or hood 47 described in detail above.

Accordingly, the turbine nozzle 28, 128 passes the cooling flow 34 to additional turbine components that require cooling and alleviates the amount of cooling flow required from the cooling source, such as the compressor 12, to effectively cool the turbine components. The cooling flow 34 is effectively "reused" by circulation through a cooling assembly that comprises an exit cavity 46 which transfers the cooling flow 34 to lower pressure regions of the turbine 16 from the microchannels 40 that are disposed within interior regions of the turbine nozzle 28 and 128. Therefore, increased overall gas turbine system 10 efficiency is achieved.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A cooling assembly for a gas turbine system comprising:

a turbine nozzle extending between opposite first and second end portions configured to mount in a hot gas path between a turbine casing and a central structure, wherein the turbine nozzle is configured to route a cooling flow only from the first end portion to the second end portion, the turbine nozzle comprises at least one channel comprising a channel inlet in the first end portion configured to receive a the cooling flow from a cooling source, wherein the at least one channel directs the cooling flow through the turbine nozzle in a radial direction at a first pressure to a channel outlet in the second end portion;

a hood surrounding an exit cavity and configured to fluidly connect the channel outlet to a region of a turbine component, wherein the region of the turbine component is at a second pressure, wherein the first pressure is greater than the second pressure, wherein the hood is configured to mount in a space between inner and outer casing walls of the turbine casing, and the hood turns from a radially outward direction to a direction along the hot gas path from the channel outlet to the turbine component.

2. The cooling assembly of claim 1, wherein the cooling source is a compressor disposed upstream of the turbine nozzle and the cooling flow is impinged on the at least one channel.

3. The cooling assembly of claim 2, wherein the turbine nozzle is disposed between and operably connected to a radially inner segment of the central structure and a radially outer segment of the inner casing wall of the turbine casing.

4. The cooling assembly of claim 3, wherein the channel inlet is disposed proximate the radially inner segment, wherein the cooling flow is directed radially outward to the channel outlet.

5. The cooling assembly of claim 1, wherein the turbine nozzle structurally separates the at least one channel from the hot gas path and blocks the cooling flow from entering the hot gas path.

6. The cooling assembly of claim 1, wherein the turbine shroud assembly is a first stage turbine shroud assembly disposed radially outward of a first turbine rotor stage.

7. The cooling assembly of claim 1, wherein the turbine nozzle comprises a plurality of paths comprising a serpentine cooling circuit, wherein the channel inlet is disposed proximate at least one of the plurality of paths, wherein the cooling flow is directed radially outward to the channel outlet, wherein the turbine component comprises a turbine shroud assembly disposed downstream of the channel outlet of the turbine nozzle, wherein the exit cavity is enclosed by the hood and directs the cooling flow to an interior region proximate a forward face of the turbine shroud assembly.

8. The cooling assembly of claim 1, wherein the turbine nozzle is mounted to a radially outer segment, wherein the channel inlet is disposed proximate a post-impingement region and the cooling flow is directed radially outward to the channel outlet.

9. The cooling assembly of claim 1, wherein the first end portion is coupled to the central structure, and the second end portion is coupled to the turbine casing.

10. The cooling assembly of claim 1, wherein the turbine nozzle comprises a plurality of paths comprising a serpentine cooling circuit, wherein the channel inlet is disposed proximate at least one of the plurality of paths, wherein the cooling flow is directed radially outward to the channel outlet.

11. A cooling assembly for a gas turbine system comprising:

a hot gas path between a turbine casing and a central structure, wherein the hot gas path is disposed about the central structure, the turbine casing comprises an inner casing wall disposed about the hot gas path and an outer casing wall disposed about the inner casing wall, and the inner casing wall comprises a turbine shroud assembly;

a turbine nozzle extending between opposite first and second end portions, wherein the turbine nozzle is disposed in the hot gas path between the turbine casing and the central structure, wherein the turbine nozzle comprises a plurality of channels each comprising a channel inlet in the first end portion configured to receive a cooling flow from a cooling source, wherein the plurality of channels directs the cooling flow through the turbine nozzle in a only one radial direction to at least one channel outlet in the second end portion;

a plurality of rotor blades rotatably disposed in the hot gas path between the turbine casing and the central structure, wherein the plurality of blades are disposed adjacent the turbine shroud assembly; and;

a hood surrounding an exit cavity and fluidly connecting the channel outlet to the turbine shroud assembly, wherein the hood is configured to route the cooling flow to the turbine shroud assembly, the hood is disposed in a space between the inner and outer casing walls of the turbine casing, and the hood turns from a radially outward direction to a direction along the hot gas path from the channel outlet to the turbine shroud assembly.

12. The cooling assembly of claim 11, wherein the cooling source comprises a compressor disposed upstream of the turbine nozzle and the cooling flow is impinged on the plurality of channels at a first pressure.

13. The cooling assembly of claim 11, wherein the first end portion is coupled to the central structure, and the second end portion is coupled to the turbine casing.

14. The cooling assembly of claim 11, wherein the channel inlet is disposed proximate the radially inner segment of the central structure, wherein the cooling flow is directed radially outward to the channel outlet.

15. The cooling assembly of claim 12, wherein the exit cavity directs the cooling flow to an interior region proximate a forward face of the turbine shroud assembly, wherein the interior region comprises a second pressure that is less than the first pressure.

16. The cooling assembly of claim 11, wherein the turbine shroud assembly is a first stage turbine shroud assembly.

17. The cooling assembly of claim 1, wherein the hood gradually decreases in width in a downstream direction from the channel outlet to the region of the turbine component.

* * * * *